US008479469B2

(12) United States Patent
Ciccarelli

(10) Patent No.: US 8,479,469 B2
(45) Date of Patent: Jul. 9, 2013

(54) FOLDABLE FORM PANEL BLOCK FOR BUILDING WALLS

(75) Inventor: Gianfranco Ciccarelli, Oytier St. Oblas (FR)

(73) Assignee: Cicabloc Industrie, Heyrieux (FR)

( * ) Notice: Subject to any disclaimer, the term of this patent is extended or adjusted under 35 U.S.C. 154(b) by 0 days.

(21) Appl. No.: 13/139,880

(22) PCT Filed: Dec. 10, 2009

(86) PCT No.: PCT/FR2009/001408

§ 371 (c)(1),
(2), (4) Date: Jul. 12, 2011

(87) PCT Pub. No.: WO2010/076410

PCT Pub. Date: Jul. 8, 2010

(65) Prior Publication Data

US 2011/0265414 A1 Nov. 3, 2011

(30) Foreign Application Priority Data

Dec. 15, 2008 (FR) ..... 08 07019

(51) Int. Cl.
*E04B 9/00* (2006.01)

(52) U.S. Cl.
USPC ..... 52/426; 52/428; 52/442; 52/563

(58) Field of Classification Search
USPC ..... 52/426, 427, 428, 442, 563, 564, 52/565, 745.15, 745.16
See application file for complete search history.

(56) References Cited

U.S. PATENT DOCUMENTS

| | | | | |
|---|---|---|---|---|
| 2,061,486 | A * | 11/1936 | Schuh | 52/565 |
| 5,459,971 | A * | 10/1995 | Sparkman | 52/426 |
| 5,473,850 | A * | 12/1995 | Balding | 52/426 |
| 5,832,687 | A * | 11/1998 | Willemsen | 52/592.6 |
| 6,890,196 | B2 * | 5/2005 | Vila | 439/165 |
| 7,032,357 | B2 * | 4/2006 | Cooper et al. | 52/426 |
| 8,033,759 | B2 * | 10/2011 | Davidsaver et al. | 405/284 |
| 8,074,419 | B1 * | 12/2011 | Humphress et al. | 52/607 |
| 2002/0026760 | A1 * | 3/2002 | Moore, Jr. | 52/309.11 |
| 2004/0103609 | A1 | 6/2004 | Wostal et al. | |
| 2008/0307745 | A1 * | 12/2008 | Lemieux | 52/745.1 |
| 2010/0326001 | A1 * | 12/2010 | Herron | 52/576 |

FOREIGN PATENT DOCUMENTS

| | | | |
|---|---|---|---|
| EP | 1 338 740 | A1 | 8/2003 |
| WO | 97/28324 | A1 | 8/1997 |
| WO | WO 9728324 | A1 * | 8/1997 |
| WO | 2006/107228 | A1 | 10/2006 |

* cited by examiner

*Primary Examiner* — Brian Glessner
*Assistant Examiner* — Adriana Figueroa
(74) *Attorney, Agent, or Firm* — Laurence A. Greenberg; Werner H. Stemer; Ralph E. Locher

(57) ABSTRACT

The invention relates to a block that comprises two longitudinal and vertical walls connected by hinges including two elements hinged about vertical axes. According to the invention, each of the two side walls is made of a rigid plastic material, is surrounded by a bent return oriented towards the inside, and includes, in the lower and upper longitudinal portions thereof, as well as on the vertical edge of one end thereof, respectively, a rebate oriented towards the outside, said rebate being capable, when the block is in the functional position, of covering the bent return of another block that has already been laid in order to provide a connection with said other block, independently from said block being in a same row or in an underlying row.

9 Claims, 7 Drawing Sheets

2

2
4
3
15
18
13

2
23
4
3
5a
13
19
15
18
8
8
7
7

B
22
46
3b
4
40
44
T
50
B

B
2
7
4b
18
15
3b
5c
2
43
42
41
42
6
6
44
40

FOLDABLE FORM PANEL BLOCK FOR BUILDING WALLS

BACKGROUND OF THE INVENTION

Field of the Invention

The invention relates to a collapsible shuttering block for building walls, intended to take the place of the traditional rubble blocks.

Traditionally, shuttering blocks, generally known as "rubble blocks" are produced individually from building material such as cement, brick or other agglomerated materials, and comprise two longitudinal and parallel vertical walls and several transverse partitions defining vertical cavities capable of receiving a filling material such as cement, concrete or earth and which may or may not have reinforcing steels.

To build a wall, the blocks, on pallets, are brought near to the building site and are then taken off by hand, one by one, to be aligned in superposed courses, with a half-block offset from one course to the next.

Each block is monolithic and is limited in its dimensions by its own weight, which is of the order of 20 to 22 kilograms, because it has to be handled manually and repeatedly by physical individuals, between its place of manufacture and a place where a wall is being built. Moreover, because of their determined and definitive parallelepipedal shape, the blocks needed for a building work have to be supplied on several pallets and therefore require heavy vehicles such as trucks and vans to transport them, and require lifting gear such as forklift trucks for handling the loaded pallets.

These various constraints limit the extent to which they can be used by private individuals wishing to self-build a boundary wall, a home or a pool.

BRIEF SUMMARY OF THE INVENTION

It is one object of the invention to provide a shuttering block which, prior to being used to build a wall, has, on the one hand, a lower mass, thus limiting the effort required for handling it and, on the other hand, a smaller size, to limit the volume it occupies for storage and transport, while at the same time, during construction, providing the same functions as a conventional block or rubble block and affording greater adaptability to suit the construction needs.

Document US2004/0103609 discloses a collapsible shuttering block which, when assembled with identical or similar blocks, is able to form insulating walls by juxtaposition in courses and superposition of these courses. Each block is made up of two longitudinal and parallel vertical walls, spaced apart and joined to one another by two-part transverse hinges, these two hinge elements being articulated to one another by a vertical articulation and articulated to the walls by other vertical articulations. Because of this structure, each block is able to have a number of configurations:

- a collapsed, storage and transport configuration in which the hinge elements are folded against one another and the shuttering block has a minimum width substantially equal to the sum of the thicknesses of its walls,
- a work configuration, in which the hinge elements are aligned with one another, the shuttering block has its maximum width and its longitudinal walls can be superposed with those of a block that has already been laid,
- and various intermediate configurations in which the wall elements are not at their maximum spacing, for example to form walls that are not as thick.

The relative positioning of the blocks is achieved by engaging longitudinal grooves, which open to the bottom and to the lower edge of each wall, onto ribs that project upward from the upper edge of each longitudinal wall.

The collapsibility of the block means that its can be reduced but entails numerous handling operations, firstly to mount the rigid plastic hinge elements onto components attached to the foam walls of the block and secondly to fit the numerous hinge pins that hinge the hinge elements and the walls together.

Moreover, positioning the blocks through interaction between ribs and grooves immobilizes the blocks only in terms of transverse translational movement and does not form a positive bond between the blocks. This construction means that when the filling material is poured, some blocks can slide longitudinally, creating gaps through which the filling material can escape.

It is a second object of the invention to provide blocks which are of low individual weight but which can, when used to build a wall, be connected to their neighbors both longitudinally and vertically to form an assembly which is monolithic, rigid and strong, particularly in terms of the ability to withstand the loadings resulting from the pouring of the filling material, and which do not require any stamping.

The invention relates, therefore, to a collapsible block, the longitudinal walls of which are connected by vertically articulated hinge elements, it thus being possible for these walls to adopt a number of configurations, these respectively being a storage configuration, a work configuration and an intermediate configuration.

According to the invention, each of the two longitudinal walls of the block is produced by molding in a rigid plastic, is surrounded by a bent return, facing towards the inside, and comprises, on the one hand and in its respectively lower or upper longitudinal part and, on the other hand, on the vertical edge of one of its ends, a V-section or U-section rebate, the opening of which faces outwards, this rebate being able, when the block is brought into the work configuration, to fit over the bent return of another block that has already been laid, to provide the connection with this other block, whether this block is juxtaposed with it in the same course or in the course below.

Thanks to that, as soon as it is laid beside another block, each block is mechanically bonded to its neighbors and forms a rigid monolithic wall that can neither be dismantled nor deformed. This arrangement guarantees the strength of the course of blocks and allows it to resist without deformation any later addition of reinforcing steels and the pouring of a filling material, such as concrete, concrete and hemp, concrete and vermiculite, raw clay, pisé, lime, straw or woodchip. Thus, Moreover, and because it has been created as a rigid plastic molding, the block by itself is far lighter than current blocks and, for example, for a standard block measuring 500×250×200 millimeters, weighs 1.4 kilograms, instead of 22 kilograms.

In addition, the hinges that connect the walls of each block allow the blocks to be stored in the collapsed state and, for example, allow 120 of these to be stacked up on a standard pallet, forming a stack 1.20 meters tall, weighing 160 kilograms. This quantity of blocks, which can make a wall with an area of 15 $m^2$, can easily be transported in a private vehicle, therefore without having to resort to a truck and a forklift truck, thus increasing the extent to which it is possible for private individuals to make use of the block.

The lightness of a block according to the invention makes it easier to handle on site, and likewise easier to position on the course of blocks laid already and bring into the intermediate position so that its wedging means can be aligned with those of the adjacent blocks. On the wall-building site, this lightness of weight also makes it easier for the walls of the block to be spaced apart so that, by the interpenetration of the wedging means, the edges of the block can be mechanically bonded to those of the blocks that have already been laid and are already in the work position.

In one embodiment and advantageously, the hinge elements are dismantleable, interchangeable and chosen from a series of elements that differ in terms of their vertical and transverse dimensions and in terms of their wall, open-worked or solid.

Thus, through the simple combination of standard longitudinal walls with suitable hinge elements it is possible to obtain a multitude of blocks which differ in terms of their width, in terms of their ability to accept various filling materials and/or in terms of their thermal and acoustic insulation.

In one embodiment of the invention, each of the longitudinal walls of the block comprises in its thickness attachment openings, for example in the shape of buttonhole slots, able to receive complementary catching means placed on the back of insulation sheets, each being made up either of a wall with vertical channels or of a solid wall to which an insulating lining is firmly applied.

Thus, the same block can take insulating sheets, of which the thermal and/or acoustic insulation capacity, toward the outside and toward the inside, is adapted to suit the requirements of the construction and can even be modified later by changing the sheets that are attached to the blocks.

In another particular embodiment, the hinge elements extend vertically over only the lower part of the shuttering block in order, in the internal upper part thereof, to form a space to receive the reinforcing steels that reinforce the shuttering blocks that are aligned on one and the same wall opening in order to form lintel formwork.

Such a block takes the place of upright structural framing members, eliminates the need to resort to lintel formwork and keeps the filling material in a protective case that can take any biological render.

For preference, in this application to formwork, each shuttering block collaborates with plates which, capable of closing off its bottom and/or at least one of its end faces, comprise:

- a flat face, parallel to the face that is to be shut off and having the same dimensions as this face,
- two longitudinal bent returns running in the continuation of the longitudinal walls of the building element, and
- wedging fins projecting into the plate, from each bent return and towards the return opposite, these fins being able to fit into the V-shaped rebates of the block that is to be closed off.

Finally, and according to a highly advantageous feature of the invention, the components of the shuttering block, and particularly its longitudinal walls, its hinge-forming transverse partitions, its closure plates and at least the core of its insulating elements, are produced by compression injection molding of a mixture of polypropylene containing 60 to 80 wt % of a fibrous material, such as sawdust.

Thanks to this composition, all the components are both strong and lightweight, while at the same time being ecologically sound.

Further features and advantages will become apparent from the description which follows, with reference to the attached schematic drawing that depicts a number of embodiments of this shuttering block, and in which:

DESCRIPTION OF THE INVENTION

In this drawing, the numerical reference 2 denotes the longitudinal walls of a block and 3 and 4 denote the hinge elements that make up the transverse partitions. Each of these elements 2 to 4, just like the elements attached to them, are obtained independently of one another by molding a rigid plastic.

In one embodiment, the various components of the blocks are molded in a mixture of polypropylene containing a proportion of the order of 60 to 80 wt % of a fibrous material such as sawdust and, for preference are obtained by compression molding, making it possible to obtain small thicknesses, even if the material has a viscosity that is higher than that of unfilled materials.

Figure 4:
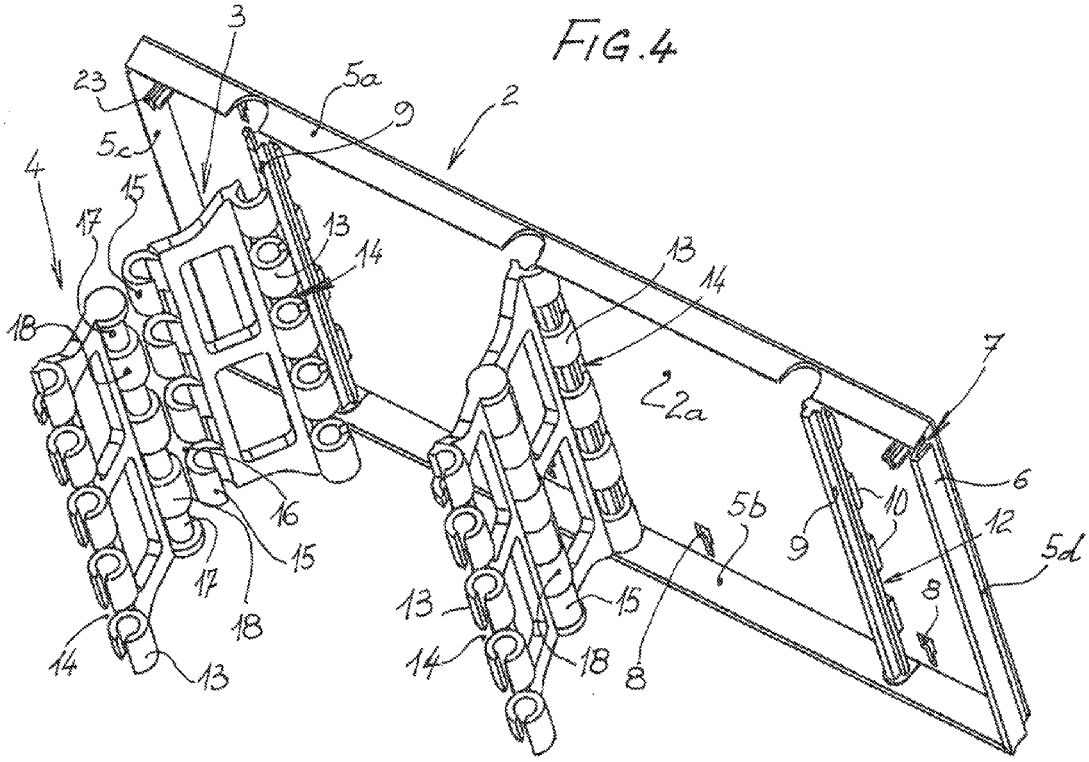
FIG. 4 is a partial perspective view, from the inside, of the wall of the block of the preceding figures, showing in detail the structure of one embodiment of the hinges.

As shown in detail by FIG. 4, each of the longitudinal walls 2 is formed of a web 2*a* surrounded by an inwardly bent return, this being respectively an upper longitudinal one 5*a*, a lower longitudinal one 5*b*, a vertical one 5*c* and a vertical one 5*d*.

In the embodiment shown in detail in this FIG. 4, the respective horizontal 5*b* and vertical 5*d* returns are each associated with a fin 6 to form a V-section or U-section rebate 7 facing outward and able to receive or fit over the catching tabs formed by the respective horizontal return 5*a* of the wall of a block in the course beneath and vertical return 5*c* of the wall of a juxtaposed block in the course that is being laid.

Figures 1, 2, 3:
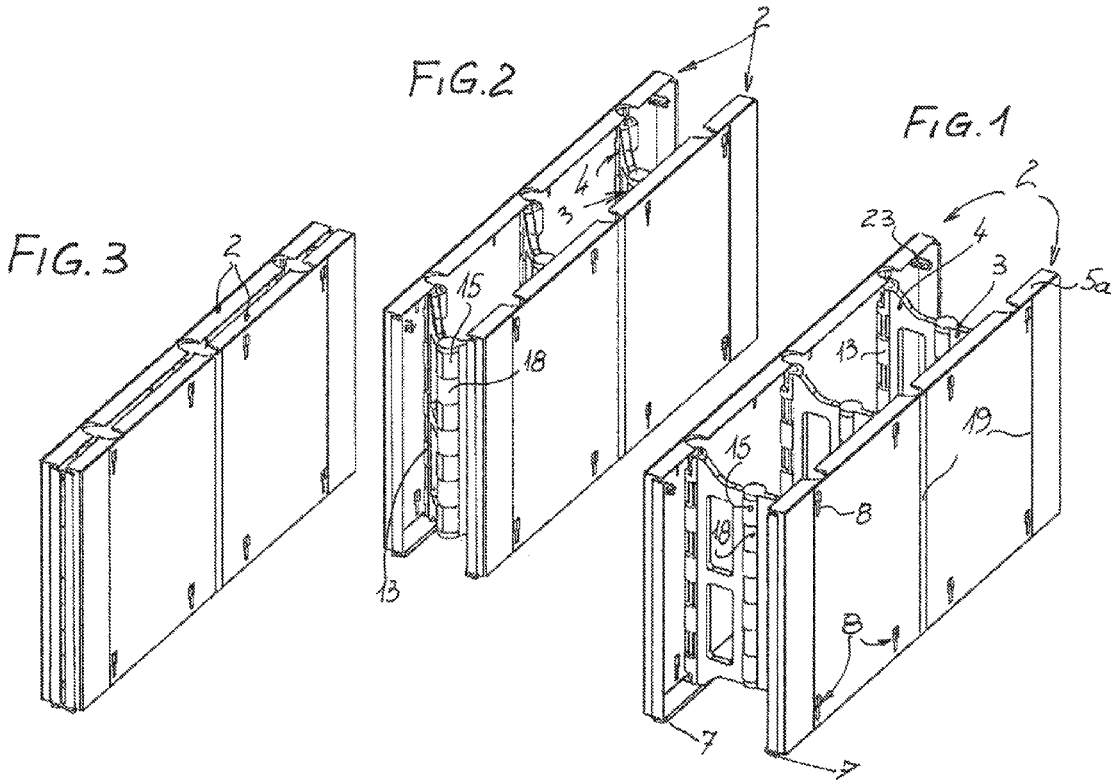
FIGS. 1, 2 and 3 are perspective views of one embodiment of the block when it is, respectively, in the work position, in the pre-mounting position and in the storage and transport position.

The web 2*a* of each wall 2 has, passing through it, catching openings 8 which, being in the shape of buttonhole slots, are arranged with the same spacing near its respective upper and lower edges. FIGS. 1 to 3 show that each wall 2, has, on its external face, vertical grooves 19 which, forming frangible thinnings, mark out the regions at which the block can be cut in order to adapt its length to suit the building need. In the example shown, there are three grooves per wall, these being arranged mid-way along the block and near its ends, but the number and distribution of such grooves may differ.

The web 2*a* of the wall also comprises, projecting from its face that faces inward, vertical ribs 9 which, constituting pivot pins, are joined to this wall by bridges of material 10 separated by vertical spaces 12. In the embodiment depicted in the drawing, each wall 2 comprises three pins 9, but depending on the embodiment, this number may differ and may vary from 1 to 5. The cross section of this pin, which has been depicted as T-shaped, may be any other shape that can be inscribed inside a circular envelope.

The pins 9 serve to articulate the hinge elements 3 and 4 each of which comprises, on its outwardly facing edge, a superposition of C-shaped hooks 13 capable of clipping onto the pin 9 in the spaces 12. Each hook 13 is separated from its neighbors by a space 14 of a height equal, give or take a functional clearance, to that of a bridge of material 10 connecting a pin 9 to the wall 2.

The hinge elements 3 and 4 are also articulated to one another by a dismantleable articulation comprising, on the internal edge of one of the elements, for example the element 3, an alternation of hooks 15 which are separated by spaces 16 and, on the internal edge of the other element, for example the element 4, an alternation of cylindrical pin sections 17 able to receive a hook 15. The sections 17 are separated by cylindrical sections 18 which, having a greater diameter than the former, connect them to the edge of the element, while at the same time holding them away from this edge, thereby forming spaces for the passage of the hooks.

It is obvious that this embodiment in which the articulation is dismantleable, although being particularly advantageous, can be replaced by any other provided that the block maintains the inter-changeability and wide angle of travel between elements, between 0 and 180 degrees, allowing the block to have the storage and transport configuration shown in FIG. 3 and the work configuration shown in FIG. 1.

Figure 9:
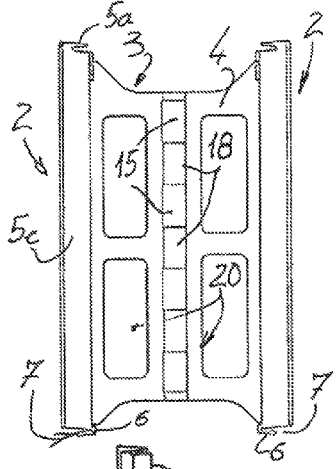
FIGS. 9 to 12 are front elevations of a number of embodiments of hinge elements.
Figure 10:
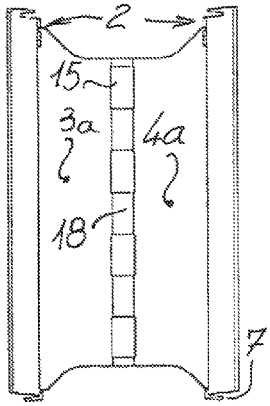
Figure 11:
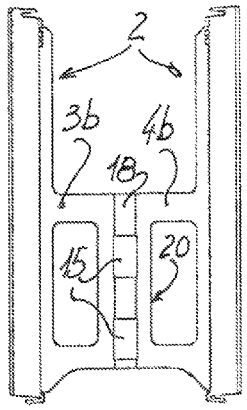

FIGS. 9 to 12 show that the interchangeability makes it possible, when assembling the components of a block, to mount between two standard walls 2, different hinge elements chosen from a series of elements, for example:

- those 3 and 4 of FIGS. 4 and 9, comprising internal slots 20 that allow the filling material through more easily,
- those 3*a* and 4*a* of FIG. 10, which have solid walls for better retention of the filling material,
- and those 3*b* and 4*b* of FIG. 11, which extend vertically over only part of the height of a block so as to form, within one course of blocks, a housing 22 to receive reinforcing steels.

Figure 12:
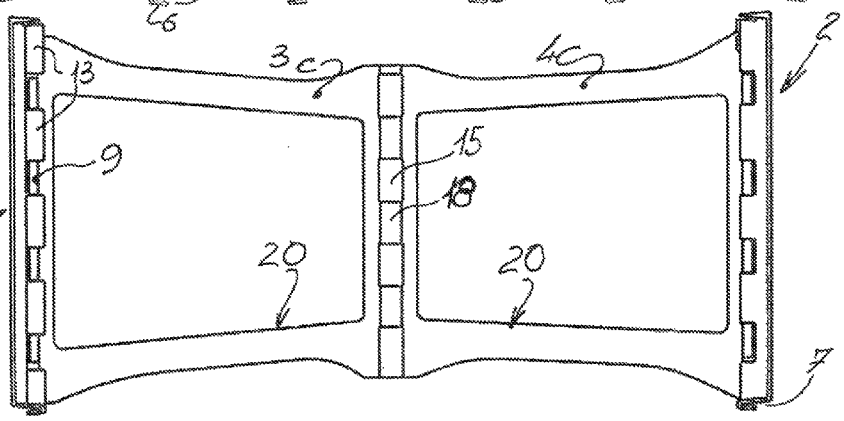

FIG. 12 shows that the hinge elements 3*c* and 4*c* may also differ in terms of their length so as to give the block different widths, it being possible for this feature to be combined with the previous features as need be. Thus, by assembling the same walls 2 with different hinge elements, it is possible to obtain a very wide range of blocks perfectly suited to the intended building needs. Recourse to walls 2 that are longer and/or taller further increases the options in the range without having a particularly great impact on the weight of the blocks or the effort involved in handling them, as would have been the case with conventional blocks.

When the components of a block are assembled, the hinge elements 3 and 4 are folded against one another as shown in FIG. 2 until the two walls 2 are against one another and give the block a thickness substantially equal to that of the two walls.

In order to allow this reduction in size, the hinge elements 3 and 4 have a height shorter than the distance between the returns 5*a* and 5*b* of the wall 2, between which returns these elements nestle.

In order to ensure that, when stacked, the mass of the stacked blocks does not damage the lowermost blocks in the stack, each wall also comprises, projecting from its internal face, a number of transverse studs 23, visible in FIG. 4, and the ends of which are at least level with the edge of the bent returns and able to come to rest against the ends of the studs of the opposite wall 2 of the same block.

Figure 5:
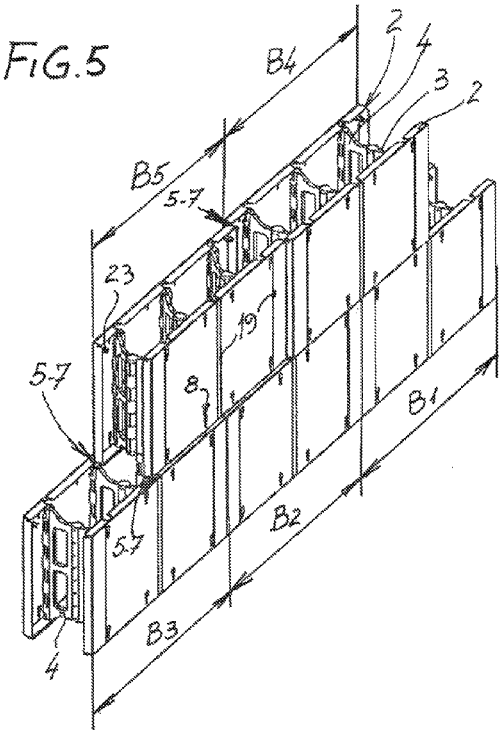
FIG. 5 is a perspective view of a section of wall formed by aligning and superposing shuttering blocks according to the invention.
Figure 6:
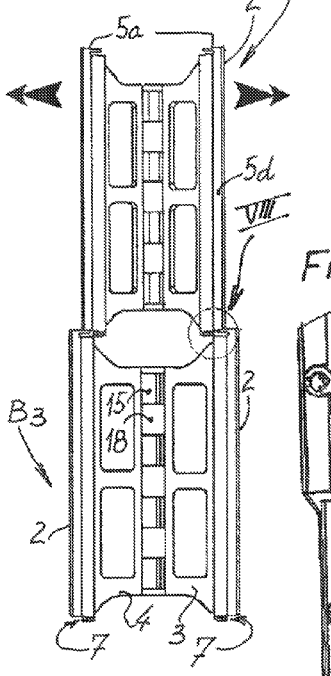
FIG. 6 is an end-on view of two courses of blocks with the upper block in the pre-mounting position.
Figure 8:
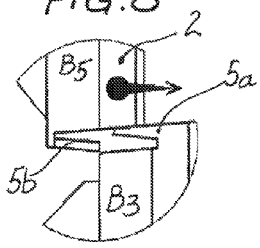
FIG. 8 is a view on a very much larger scale of section VIII in FIG. 6, showing the interpenetration of a tab in a rebate.
Figure 7:
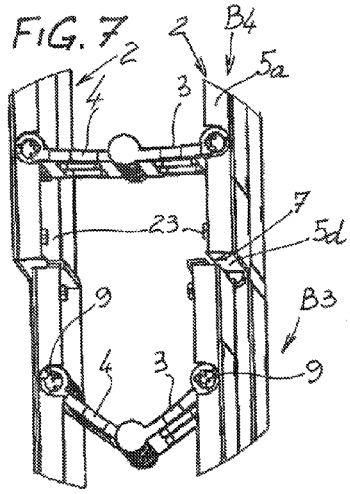
FIG. 7 is a partial plan view, from above and on a larger scale, showing two blocks in the process of being assembled.

In order to build a wall made up, for example, as shown in FIG. 5, of a course of blocks B1, B2 and B3, onto which another course formed of a block B4 is built, a block B5 must be taken from stock with its hinges in the folded state and then the hinges must be opened out to bring the block into the premounting configuration shown in FIGS. 2, 5, 6 and 7. This configuration allows the bricklayer to position the block B5 longitudinally in contact with the end face of the block B4 and to position the same block B5 transversely so that its vertical mid-plane is more or less in the longitudinal and vertical mid-plane of the courses of laid blocks. Thus, as FIG. 8 shows, the lower rebates 7 of the block B5 face but are not in contact with the catching tabs formed by the returns 5*a* of the block B3 below, while, as FIG. 7 shows, the vertical rebates 7 of the block B5 face but are not in contact with the vertical catching tabs formed by the vertical returns 5*c* of the block B4.

Thus, when the walls 2 are parted to bring the block B5 into its work position and into its greatest width, the rebates 7 fit over the tabs and provide the bond between the added block B5 and the blocks B3 and B4 that have already been laid. This bond occurs on two vertical edge faces and two horizontal edge faces and is locked by the hinge elements which are aligned with one another. The fitting of the next element and of the two elements above it that rest on the block B5, bond the last four edge faces to these blocks.

It is thus possible to form a monolithic assembly that is strong and does not risk deforming or locally coming apart under the loads applied to it when the reinforcing steels are fitted and the filling material, such as cement, concrete, concrete and hemp, concrete and pouring vermiculite, clay, pisé, lime, straw, woodchip and other materials chosen according to the desired thermal and/or acoustic insulation properties, is poured.

The monolithic nature of the wall also makes it possible, before the wall is filled and with no danger of the blocks separating, to feed into the vertical channels, formed by the superposition of the blocks, the various networks of a building such as the cold and hot water networks, the electricity, computer, sound, etc. networks.

Figure 13:
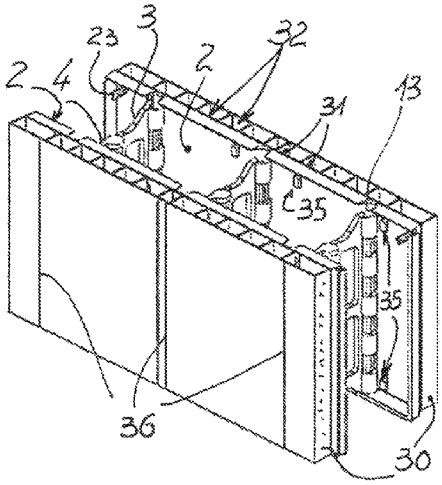
FIGS. 13 and 14 are perspective views showing two embodiments of insulating blocks.
Figure 14:
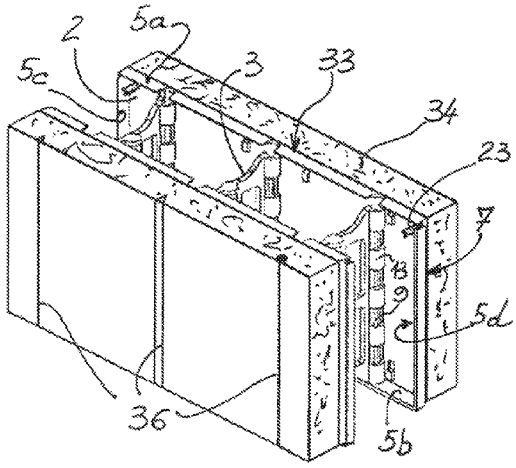

FIGS. 13 and 14 show that each block, on one of its faces or on each of its outer faces, may accept a thermal and/or acoustic insulating lining, at the time of assembly of its components or after a wall has been built. Each lining has a length and a height equal to those of a block.

In FIG. 13, each lining consists of a double-walled plastic panel 30 in which vertical ribs 31 delimit vertical channels 32 containing air and providing insulation.

In FIG. 14, the lining is made up of a solid plastic sheet 33 against which a panel 34 of insulating material, such as polyurethane foam, polystyrene or some other insulating material, is attached.

Each panel 30 and sheet 33 has means of attachment 35 which, protruding from that one of its faces that is to be applied against a block, have shapes that complement the shapes of the buttonhole slots 8 so that they can catch therein.

Moreover, each panel 30, each sheet 33 and each insulating panel 34 comprises, in its outer face, vertical grooves 36 that allow it to be cut so that its length can be tailored to that of the block.

Figures 15, 16:
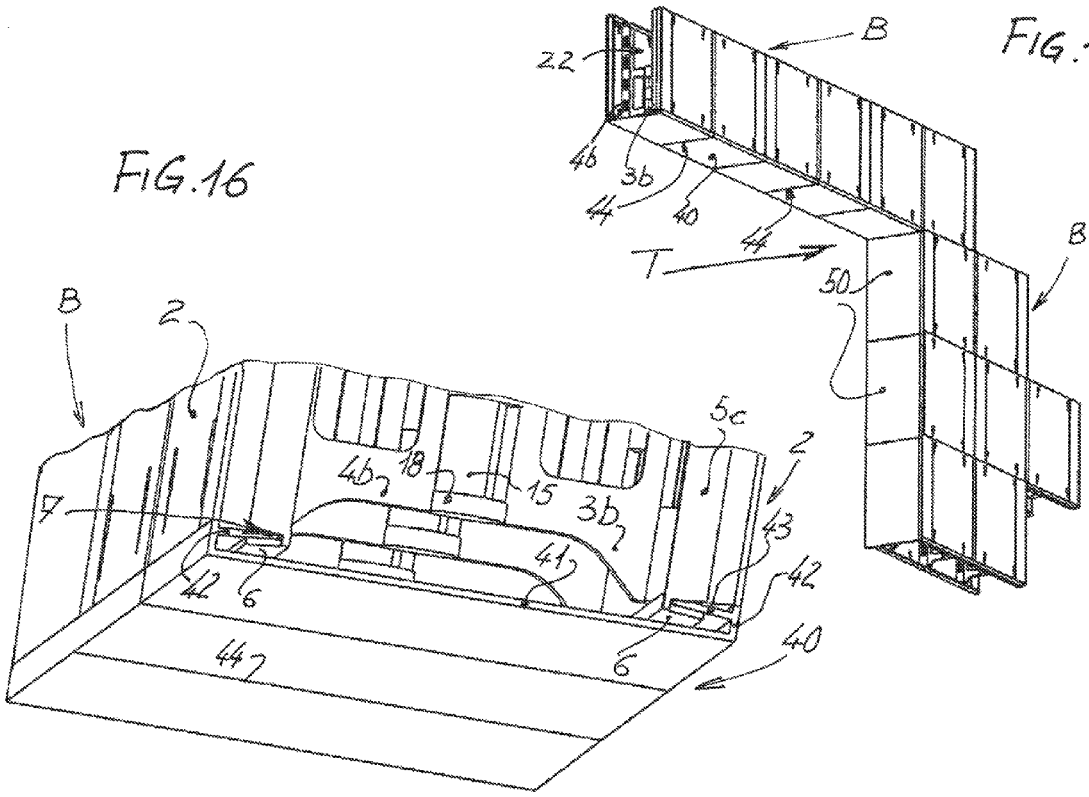
FIG. 15 is a perspective view of the lintel formwork formed by a number of shuttering blocks.
FIG. 16 is a partial view, in perspective and on a larger scale, showing one of the blocks of FIG. 15, equipped with an end wall.

The embodiment shown in FIGS. 15 and 16 relates to the creation of lintel formwork C using blocks B according to the invention. Each block is a block like the one in FIG. 11, that is to say comprises hinge elements 3*b* and 4*b* delimiting an upper housing 22 to house the reinforcing bars and other reinforcing steels. The bottom of each block B forming the casing of the lintel is closed off by a bottom plate 40 which, as shown in detail in FIG. 16, comprises:

- a flat wall 41, the width and length of which correspond to those of a block,
- longitudinal bent returns 42,
- and wedging fins 43, projecting into the plate from each return 42.

When each block B, now resting on a supporting plank, positioned in the opening T, the lintel of which requires formwork, is brought into the work configuration by parting its longitudinal walls 2, its lower and longitudinal rebates 7 fit over the wedging fins 43 at the bottom at the same time as the vertical rebates 7 of its end faces 7 fit over the vertical returns 5*c* of the end face of the block B already laid.

In the same way, the lateral face of the endmost block of each of the courses of blocks B bordering the opening T is closed off by an end plate 50 similar to the bottom plate 40, that is to say which has a solid plate, lateral bent returns and wedging fins capable of collaborating with the vertical rebates 7 or with the vertical bent returns 5*c* of the blocks, but which differs from this plate 40 in terms of its length, which corresponds to the height of a block rather than to the length thereof.

Once again, the exterior face of each of the bottom plates 40 comprises grooves 44 marking the places where it can be split.

FIG. 15 clearly shows that the bottom plates 40 and the end plates 50 not only close the formwork thereby preventing the filling material from escaping as it is poured, but also contribute to the finish of the surround of the opening by forming supports that can take any render or any add-on facing elements.

Figure 17:
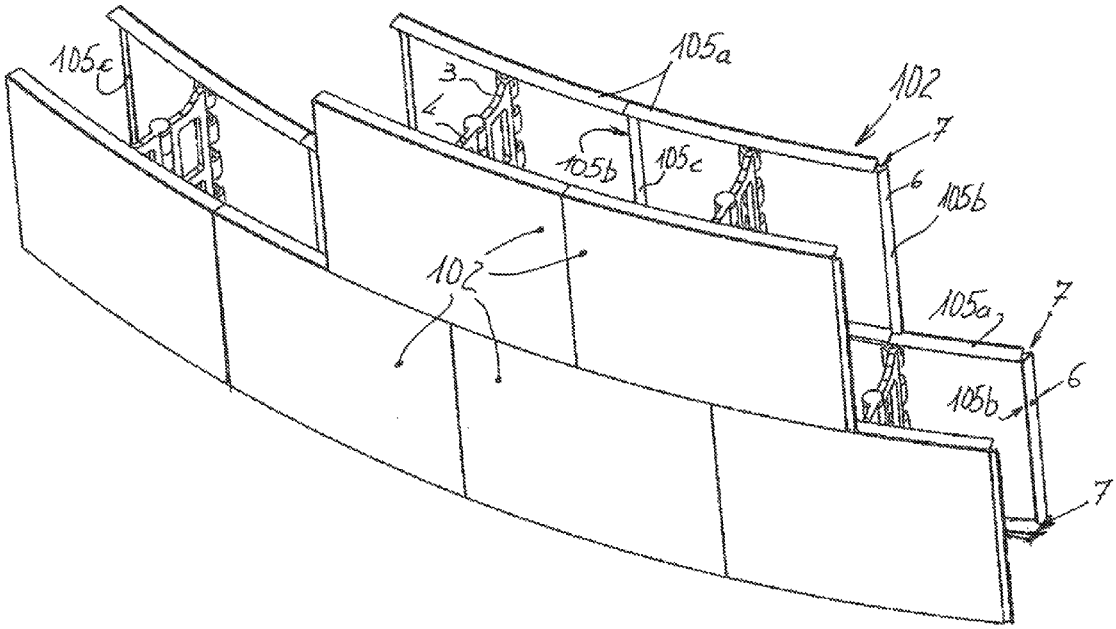
FIG. 17 is a perspective view of a curved section of wall, formed by blocks with curved walls.

Finally, and as FIG. 17 shows, the longitudinal walls 102*a* and 102*b* of each block may, while still remaining parallel, be curved into a circular arc with concentric radii, to form circular walls. The transverse partitions, still formed of hinge elements 3 and 4 chosen from a series of different elements, may number 1 to 5 per block, depending on the length thereof.

It is evident from the foregoing description that the shuttering block according to the invention affords numerous advantages over existing blocks:

- ability to move its longitudinal walls which, when moved closer together, afford collapsibility making for easier storage and stacking on a pallet and, when moved apart, allow it to hook onto the adjacent blocks,
- lightness of weight, reducing the physical effort involved in handling it,
- closer tolerances, both in manufacture and in the building of a wall or formwork,
- adaptability to suit site requirements, in terms of its dimensions, in particular of its width which can vary from 150 to 500 millimeters, and in terms of the nature of its transverse partitions, solid or open-worked, tall or mid-height, and in terms of its thermal and/or acoustic insulation and in terms of the choice of its filling material,
- elimination of the need for any mortar or adhesive for joining together blocks that are spread in superposed courses, hence eliminating the risks of cracking at the joints,
- reduction and simplification of support structures needed for laying it, particularly elimination of any stamping and of upright structural framing members for light-weight concrete.

The invention claimed is:

1. A collapsible shuttering block for building walls by assembling the block with other identical or similar blocks, the block comprising:

- two longitudinal and parallel vertical walls of rigid molded plastic each having an inwardly bent surrounding return;
- said return including a continuous rigid upper part, a continuous rigid lower part and two continuous rigid ends with vertical edges;
- one of said upper and lower parts and said vertical edge of one of said ends each having a respective V-shaped section or U-shaped section rebate with an outwardly-facing opening;
- hinges interconnecting said walls and having hinge elements and vertical pins articulating said hinge elements to one another and to said walls to give the block various configurations;
- said hinge elements being movable between:
  - a collapsed, storage and transport configuration with said hinge elements folded against one another and the block having a minimum width,
  - a work configuration with the block having a maximum width, and
  - an intermediate configuration with said walls not at a maximum spacing, but configured to rest on blocks beneath and facilitate relative positioning of the block with respect to blocks having already been laid, before bringing the block into said work configuration;
- said rebates configured to fit over said return of another block having already been laid, upon bringing the block into said work configuration, to provide a connection with the other block, whether the other block is juxtaposed with the block in the same course or in a course below; and
- plates configured to respectively close off a bottom and at least one end of the block, said plates each including:
  - a solid wall parallel to and having the same dimensions as a face to be shut off;
  - two longitudinal bent returns; and
  - wedging fins projecting into said plate from each of said bent returns and towards an opposite one of said bent returns, said fins configured to fit into said rebates of the block to be closed off.

2. The shuttering block according to claim 1, wherein said hinge elements are configured to be dismantled and interchanged and are selected from a group consisting of elements differing in vertical and transverse dimensions and elements having open-worked or solid walls.

3. The shuttering block according to claim 1, wherein each of said hinge elements includes an outer vertical edge configured to be articulated to said wall, and a superposition of C-shaped hooks on said outer vertical edge configured to clip elastically onto a vertical pin spaced away from said wall by bridges of material, said bridges being vertically spaced from one another to form passages for accepting said hooks, between said wall and said vertical pin.

4. The shuttering block according to claim 1, wherein:

one of said hinge elements of each of said hinges includes an inner vertical edge configured to articulate said one hinge element to another of said hinge elements and an alternation of vertically-spaced C-shaped hooks on said inner vertical edge; and another of said hinge elements of each of said hinges includes an inner vertical edge and superposed and spaced-apart cylindrical-pin sections on said inner vertical edge each configured to receive a respective one of said hooks of said one hinge element, said pin sections alternating vertically with bridges of material of a greater diameter than said pin sections connecting said pin sections to said vertical edge of said other hinge element and holding said pin sections away from said vertical edge of said other hinge element.

5. The shuttering block according to claim 1, wherein said hinge elements extend vertically over only a lower part of the block to form a space in an internal upper part of the block configured to receive steel reinforcing blocks aligned on one wall opening to form a formwork for a lintel.

6. The shuttering block according to claim 1, wherein each of said walls has a thickness with attachment slots formed therein and configured to receive complementary catches projecting from insulation panels and insulation sheets, said insulation panels having a wall with internal and vertical cavities and said insulation sheets having a solid wall to which an insulating lining is firmly applied.

7. The shuttering block according to claim 6, wherein said attachment slots have a buttonhole slot shape.

8. The shuttering block according to claim 1, which further comprises:

insulating panel walls or insulation sheet walls;

said longitudinal and parallel vertical walls, said hinge elements, said plates and at least said insulating panel walls or insulation sheet walls having characteristics of a component produced by compression injection molding of a mixture of polypropylene containing 60 to 80 wt % of a fibrous material.

9. The shuttering block according to claim 8, wherein said fibrous material is sawdust.

* * * * *